US010914180B2

(12) United States Patent
Pernleitner et al.

(10) Patent No.: US 10,914,180 B2
(45) Date of Patent: Feb. 9, 2021

(54) SHROUD SEGMENT FOR DISPOSITION ON A BLADE OF A TURBOMACHINE, AND BLADE

(71) Applicant: MTU Aero Engines AG, Munich (DE)

(72) Inventors: Martin Pernleitner, Dachau (DE); Klaus Wittig, Roehrmoos (DE); Lutz Friedrich, Munich (DE)

(73) Assignee: MTU Aero Engines AG, Munich (DE)

( * ) Notice: Subject to any disclaimer, the term of this patent is extended or adjusted under 35 U.S.C. 154(b) by 64 days.

(21) Appl. No.: 16/249,079

(22) Filed: Jan. 16, 2019

(65) Prior Publication Data

US 2019/0234219 A1 Aug. 1, 2019

(30) Foreign Application Priority Data

Jan. 29, 2018 (DE) ..... 10 2018 201 265

(51) Int. Cl.
*F01D 5/20* (2006.01)
*F01D 5/14* (2006.01)
*F01D 5/22* (2006.01)

(52) U.S. Cl.
CPC ..... *F01D 5/20* (2013.01); *F01D 5/147* (2013.01); *F01D 5/225* (2013.01); *F05D 2230/10* (2013.01); *F05D 2230/21* (2013.01); *F05D 2240/307* (2013.01); *F05D 2250/75* (2013.01); *F05D 2260/941* (2013.01)

(58) Field of Classification Search
CPC . F01D 5/20; F01D 5/147; F01D 5/225; F05D 2240/307
See application file for complete search history.

(56) References Cited

U.S. PATENT DOCUMENTS 5,971,710 A * 10/1999 Stauffer ..... B23P 6/002 415/118
6,491,498 B1 12/2002 Seleski et al.
8,006,381 B2 8/2011 Haehnle et al.
9,322,281 B2 * 4/2016 Schlemmer ..... F01D 5/225
(Continued)

FOREIGN PATENT DOCUMENTS

DE 10328310 A1 1/2005
DE 102009030566 12/2010
(Continued)

*Primary Examiner* — Courtney D Heinle
*Assistant Examiner* — Michael K. Reitz
(74) *Attorney, Agent, or Firm* — Davidson, Davidson & Kappel, LLC

(57) ABSTRACT

A shroud segment (100) for disposition on a blade of a turbomachine is provided, in particular a gas turbine, the shroud segment having a stiffening structure raised above a shroud segment surface (15), the stiffening structure including at least three interconnected ribs (3, 5, 7), and a first end portion of the ribs (3, 5, 7) being connected to an upstream sealing tip (11) of the shroud segment (100), and a second end portion of these ribs (3, 5, 7) being connected to a downstream sealing tip (13) of the shroud segment (100). The angles (W1, W2, W3) between the direction of the axis of rotation (a) of the blade and the longitudinal orientations (21, 23, 25) of the ribs (3, 5, 7), as viewed in the direction of flow (9) through the turbomachine, are between zero degrees and eighty degrees. The present invention also relates to a blade (200) of a turbomachine.

19 Claims, 2 Drawing Sheets

(56) References Cited

U.S. PATENT DOCUMENTS

| | | | |
|---|---|---|---|
| 9,631,500 | B2 | 4/2017 | Pierre et al. |
| 9,963,980 | B2 | 5/2018 | Negri et al. |
| 2012/0003078 | A1 | 1/2012 | Pikul et al. |
| 2012/0107123 | A1 | 5/2012 | Schlemmer |
| 2015/0226070 | A1 | 8/2015 | Plante et al. |
| 2016/0237829 | A1 | 8/2016 | Kozdras et al. |

FOREIGN PATENT DOCUMENTS

| | | | |
|---|---|---|---|
| DE | 102014115266 | A1 | 4/2015 |
| EP | 3006673 | A1 | 4/2016 |
| EP | 3056677 | A1 | 8/2016 |
| WO | WO03/029616 | | 4/2003 |
| WO | WO2014105533 | A1 | 7/2014 |
| WO | WO2014118456 | A1 | 8/2014 |
| WO | WO2014137479 | A1 | 9/2014 |

* cited by examiner

SHROUD SEGMENT FOR DISPOSITION ON A BLADE OF A TURBOMACHINE, AND BLADE

This claims the benefit of German Patent Application DE 10 2018 201 265.2, filed Jan. 29, 2018 which is hereby incorporated by reference herein.

The present invention relates to a shroud segment for disposition on a blade of a turbomachine.

BACKGROUND

Rotors of compressor stages and/or turbine stages of turbomachines can be subjected to high forces, in particular centrifugal forces, at high rotational speeds. These centrifugal forces can cause deformations of or even material damage to the rotors. In order to counteract such deformations and material damage, outer shrouds of high-speed turbine blades can be structurally reinforced. One way of providing such reinforcement is by enhancing the stiffness of the outer shroud through design measures.

SUMMARY OF THE INVENTION

It is an object of the present invention to provide a shroud segment having a high stiffness. Another object of the present invention is to provide a blade having a shroud segment that has a high stiffness.

The present invention provides a shroud segment for disposition on a blade of a turbomachine, in particular a gas turbine, the shroud segment having a stiffening structure raised above a shroud segment surface. The stiffening structure includes at least three interconnected ribs. The ribs may be referred to as stiffening ribs or webs. A first end portion of each of the at least three ribs is connected to an upstream sealing tip of the shroud segment, the end portion being with respect to the longitudinal orientations or main axes of the ribs. A second end portion, considered with respect to the opposite second longitudinal end of the ribs, is connected to a downstream sealing tip of the shroud segment. The angles between the direction of the axis of rotation of the blade and the longitudinal orientations of the ribs, as viewed in the direction of flow through the turbomachine, are between zero degrees and eighty degrees.

The blade includes a shroud segment for disposition on a blade of a turbomachine, the shroud segment having a stiffening structure raised above a shroud segment surface. The stiffening structure includes at least three interconnected ribs. A first end portion of the at least three ribs is connected to an upstream sealing tip of the shroud segment. A second end portion, considered with respect to the opposite second end of the ribs, is connected to a downstream sealing tip of the shroud segment. The angles between the direction of the axis of rotation of the blade and the longitudinal orientations of the ribs, as viewed in the direction of flow through the turbomachine, are between zero degrees and eighty degrees. In some specific embodiments, the blade of the present invention is manufactured as a single piece, for example by a casting process or by a generative manufacturing process.

The inventive blade may be a compressor blade and/or a turbine blade of a gas turbine.

Advantageous refinements of the present invention are the subject matter of the specific embodiments.

Specific exemplary embodiments of the present invention may include one or more of the features set forth below in any combination unless a, or the, particular combination is readily understood by the skilled person to be technically impossible. Specific exemplary embodiments of the present invention are also defined by the respective subject matters of the dependent claims.

In all of the above and following discussion, the expressions "may be," respectively "may have," etc., will be understood to be synonymous with "is preferably," respectively "preferably has," etc., and are intended to illustrate specific exemplary embodiments of the present invention.

Whenever alternatives are introduced with "and/or" herein, the "or" contained therein is preferably understood by the skilled person as "either or" and preferably not as "and."

The specific embodiments set forth herein are to be understood as inventive, merely exemplary embodiments of the present invention and are not meant to be limiting.

A raised stiffening structure is, in particular, a structure of material accumulations, such as ribs, webs, or the like, which extend radially outwardly from the shroud segment surface in the radial direction. The stiffening structure may be made of the same material as or a different material than the remainder of the shroud or portions thereof.

In some specific embodiments, the three interconnected ribs of the inventive shroud form a Z-shaped rib structure.

A sealing tip may be referred to as a sealing fin. A shroud or a shroud segment may be disposed on a blade tip. One, two or more sealing tips on these shrouds or shroud segments may rub into an abradable portion of an abradable seal in a casing portion of the turbomachine. Due to this rubbing contact, a sealing gap may form between the shroud and the casing, the sealing gap minimizing flow losses due to backflow or leakage flow. In other words, the shroud segment may reduce flow around the radially outer blade tip, thereby increasing the efficiency of the turbomachine. The shroud segments of neighboring or adjacent blades of a rotor form a continuous shroud.

In the following, the upstream sealing tip will be referred to as a front sealing tip and the downstream sealing tip will be referred to as a rear sealing tip.

In some specific embodiments, a first end portion of a first rib is connected to a first end portion of a second rib. The two interconnected end portions are disposed at the front sealing tip and, in particular, are connected to the sealing tip by a material-to-material bond. A first end portion of a third rib is offset in the circumferential direction, the offset position being with respect to the connected end portions of the first and second ribs. This first end portion of the third rib is also disposed at the front sealing tip and, in particular, connected to the sealing tip by a material-to-material bond. The distance between the offset position of the end portion of the third rib and the connected end portions of the first and second ribs is, in particular, at least equal to the (circumferential) width of the interconnected end portions of the first and second ribs disposed at the front sealing tip.

In particular, the angle between the direction of the axis of rotation of the blade and the longitudinal orientation of the first rib may be between 0° and 45°, the angle between the direction of the axis of rotation of the blade and the longitudinal orientation of the third rib may be between 0° and 45° and/or the angle between the direction of the axis of rotation of the blade and the longitudinal orientation of the second rib may be between 30° and 80°.

Preferably, the mean camber line of the airfoil intersects the second rib, preferably all three ribs, at an angle of between 30° and 90°, preferably between 45° and 90°, when viewed radially. The mean camber line runs through the center of any circle that is completely inscribed in the airfoil as a maximum circle at a particular axial position.

The respective end portions of the ribs disposed at the sealing tips may be referred to as roots.

In some specific embodiments, a second end portion of the first rib is disposed at the rear sealing tip and, in particular, connected to the sealing tip by a material-to-material bond. A second end portion of the second rib is connected to a second end portion of the third rib. These connected end portions are disposed at the rear sealing tip at an offset in the circumferential direction from the second end portion of the first rib.

The aforedescribed end portions of the respective ribs disposed at the front and rear sealing tips advantageously allow the stiffness of the shroud segment to be increased.

In some specific embodiments, a first polygonal pocket is formed between the side faces of the first and second ribs, the rear sealing tip and the shroud segment surface as the bottom surface. Furthermore, a second polygonal pocket is formed between the second and third ribs, the front sealing tip and the shroud segment surface. A pocket may be referred to as a depression, trough, basin, or the like. A polygonal pocket is a pocket having a plurality of sides. The pockets have more than three side faces. The side faces of the first polygonal pocket are essentially formed by the first rib, the second rib and the rear sealing tip. The side faces of the second polygonal pocket are essentially formed by the second rib, the third rib and the front sealing tip. Each of the two pockets may have a plurality of side faces. For example, further side faces may be formed at the respective roots and/or at the transition regions between the ribs and the shroud segment surface. The polygonal pockets, particularly those having more than three side faces, advantageously allow the stiffness of the shroud segment to be increased.

In some specific embodiments, the three ribs are substantially straight along their longitudinal orientations; i.e., along their main axes. In other specific embodiments, some or all of the main axes are curved, for example singly or multiply curved.

In some specific embodiments, the end portion of the third rib that is located at the front sealing tip is disposed at the joint surface of the shroud segment facing the next adjacent shroud segment. A plurality of shroud segments may form a shroud.

In some specific embodiments, the end portion of the first rib that is located at the rear sealing tip is disposed in the middle third relative to the length of the shroud segment in the circumferential direction.

In some specific embodiments, the angles between the direction of the axis of rotation of the blade; i.e., axial direction a, and the longitudinal directions of the first and third ribs, as viewed in the direction of flow through the turbomachine, are between twenty degrees and seventy degrees, in particular between thirty degrees and fifty degrees, and more particularly about forty-five degrees. In other specific embodiments, the angles between the direction of the axis of rotation of the blade and the longitudinal directions of the first and third ribs are zero degrees or nearly zero degrees.

In some specific embodiments, the ribs have a substantially constant height in the radial direction over the circumference.

In some specific embodiments, the shroud segment is manufactured as a single piece by a casting process, by a material-removal process, in particular by milling, or by a generative manufacturing process.

Some or all of the embodiments of the present invention may have one, several or all of the advantages mentioned above and/or hereinafter.

The shroud segment of the present invention advantageously makes it possible to provide high stiffness for the shroud or outer shroud, in particular in the case of high-speed turbine blades. One parameter in this connection is the product $AN^2$, where A is the annular area formed by the blades, in particular turbine blades, and more particularly by the downstreammost stage. N is the rotational speed of the blades when in use. Large shroud overhangs may occur particularly in the case of low blade counts or very high $AN^2$. In this connection, the taper in area may be very large in a radial direction from the inside to the outside. In accordance with the present invention, in order to prevent these shroud overhangs from being excessively bent up by potentially high centrifugal forces, ribs may be incorporated into the shroud. Further, it is advantageous that the increase in mass resulting from the stiffening structures in the form of ribs be as small as possible.

BRIEF DESCRIPTION OF THE DRAWINGS

The present invention will now be described, by way of example, with reference to the accompanying drawings, in which identical or similar components are indicated by the same reference numerals. The figures show in greatly simplified schematic form in.

DETAILED DESCRIPTION

Figure 1:
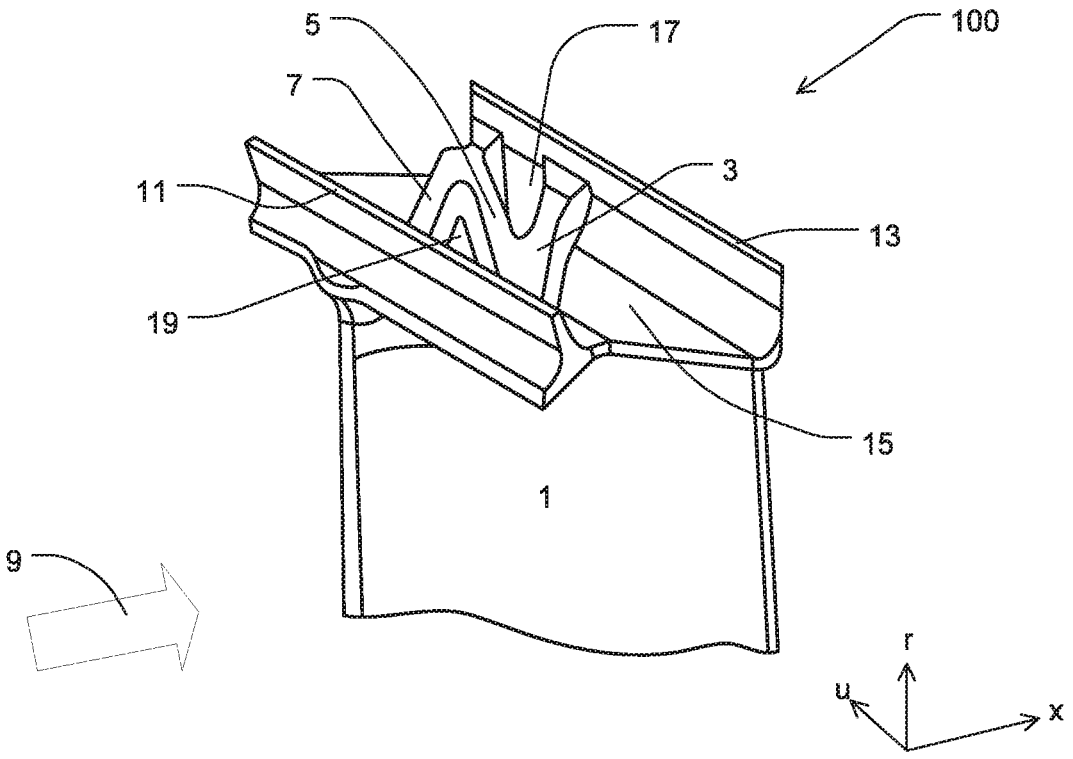
FIG. 1: a perspective view of inventive shroud segment having a stiffening structure, and an airfoil connected to the shroud segment.

FIG. 1 shows, in perspective view, an inventive shroud segment 100 having a stiffening structure, and an airfoil 1 connected to shroud segment 100.

The stiffening structure includes three interconnected ribs 3, 5, 7. Ribs 3, 5, 7 extend along their longitudinal orientations; i.e., along their main axes, from an upstream sealing tip 11 to a downstream sealing tip 13, as viewed in a main flow direction 9 through the turbomachine. For the sake of simplification, upstream sealing tip 11 will hereinafter be referred to as a front sealing tip 11, and downstream sealing tip 13 will hereinafter be referred to as a rear sealing tip 13. Furthermore, front sealing tip 11 may be referred to as a leading-edge sealing tip and rear sealing tip 13 may be referred to as a trailing-edge sealing tip. Sealing tips 11, 13 may be referred to as sealing fins. Ribs 3, 5, 7 are connected to a shroud segment surface 15.

In a merely exemplary use of shroud segment 100 in a gas turbine, for example a use in a compressor stage and/or in a turbine stage, sealing tips 11, 13 may rub into an abradable portion of an abradable seal in a casing portion of the gas turbine as shroud segment 100 rotates with airfoil 1 or as a complete shroud rotates with airfoils. Due to this rubbing contact, a sealing gap may form between the shroud and the casing, the sealing gap minimizing flow losses due to backflow or leakage flow. In other words, shroud segment 100 may reduce flow around the radially outer blade tip, thereby increasing the efficiency of the turbomachine. The shroud segments 100 of neighboring or adjacent blades of a rotor form a continuous shroud.

The shroud segment 100 disposed on the radial end portion of airfoil 1 may generally be used to damp blade vibrations, in particular in the case of gas turbine blades for rear; i.e. downstream turbine stages. In order to enhance or increase the stiffness of, in particular, high-speed turbine blades, the shrouds may advantageously include the shroud segments 100 according to the present invention. The raised stiffening structures of the inventive shroud segments 100 may also contribute to reducing stress concentrations of the shroud.

To simplify the description, the three interconnected ribs 3, 5, 7 will hereinafter be referred to as first rib 3, second rib 5, and third rib 7. In this exemplary embodiment, the angles between the direction of the axis of rotation of the blade, which is referred to as axial direction a and represents main flow direction 9, and the longitudinal orientations of the three ribs 3, 5, 7, as viewed in axial direction a, are, by way of example, between about thirty degrees and eighty degrees. This is illustrated in more detail in FIG. 2.

A first polygonal pocket 17, which may be referred to as a trough-shaped depression, is formed between first rib 3, second rib 5 and rear sealing tip 13. First polygonal pocket 17 is disposed between the connection regions of first rib 3 and second rib 5, of first rib 3 and rear sealing tip 13, and between second rib 5 and rear sealing tip 13. Analogously, a second polygonal pocket 19 is formed between second rib 5, third rib 7 and front sealing tip 11. Second polygonal pocket 19 is disposed between the connection regions of second rib 5 and third rib 7, of second rib 5 and front sealing tip 11, and between third rib 7 and front sealing tip 11.

Sealing tips 11, 13 extend over their entire extent from below shroud segment surface 15; i.e., in the region of the radially outermost edge of airfoil 1, upwardly beyond shroud segment surface 15. The region of incursion into an optional abradable seal in the casing portion of the turbomachine is located in the radially outermost region of sealing tips 11, 13.

The blade according to the present invention includes at least one inventive shroud segment 100, an airfoil 1, and a blade root (not shown in FIG. 1). The blade may be manufactured as a single-piece casting, by a material-removal process, in particular by milling, or by a generative manufacturing process.

Figure 2:
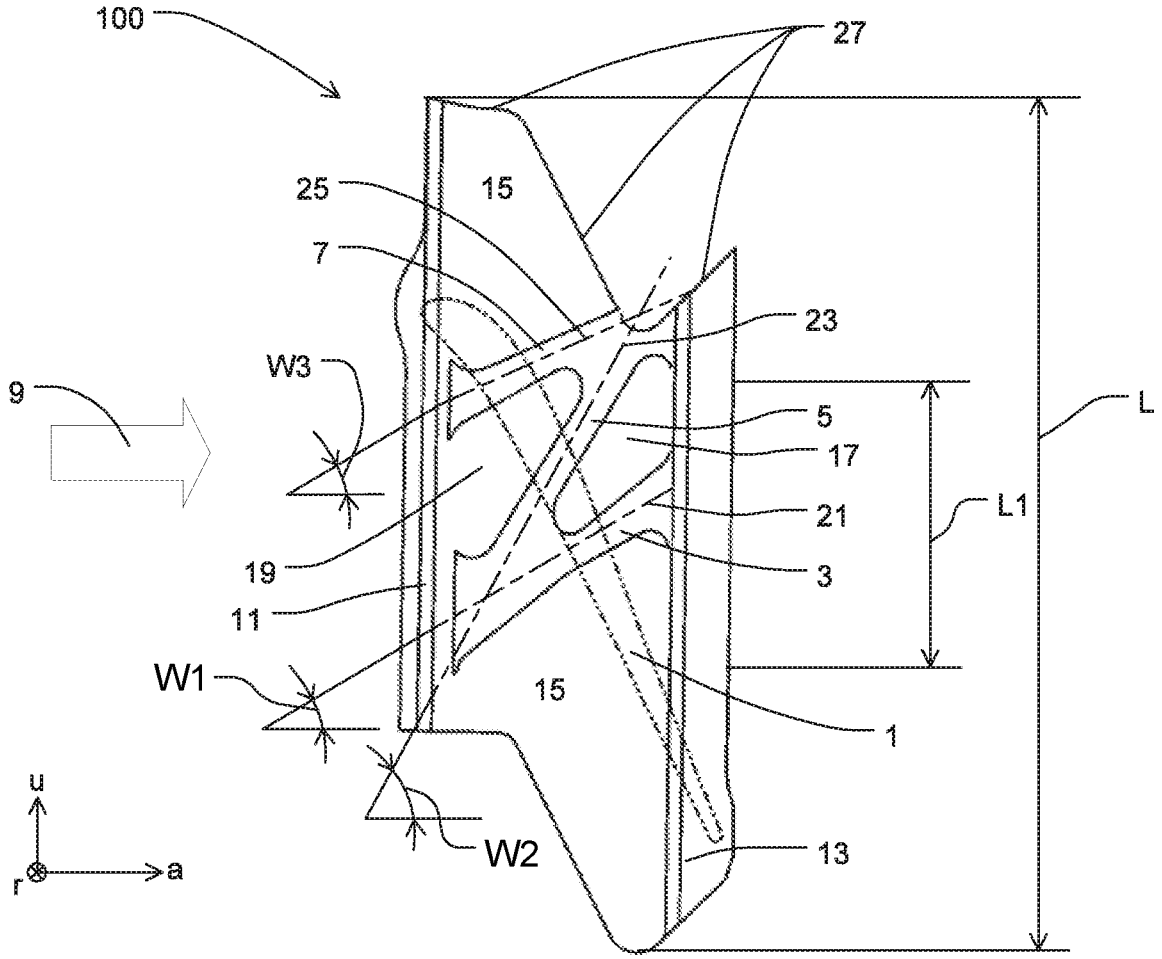
FIG. 2: a plan view looking radially inwardly on the inventive shroud segment of FIG. 1.

FIG. 2 shows a plan view looking radially inwardly on the inventive shroud segment 100 of FIG. 1. First ribs 3, second rib 5, and third rib 7 extend along their longitudinal orientations; i.e., along first main axis 21 of first rib 3, along second main axis 23 of second rib 5,*b* and along third main axis 25 of third rib 7, from front sealing tip 11 to rear sealing tip 13. The three ribs 3, 5, 7 are oriented substantially straight along their main axes 21, 23, 25.

Ribs 3, 5, 7 are connected to sealing tips 11, 13 and, in this exemplary embodiment, to shroud segment surface 15. In particular, the raised stiffening structure in the form of ribs 3, 5, 7 is manufactured in one piece with shroud segment surface 15 and sealing tips 11, 13, for example by a casting process or by a generative manufacturing process. In FIG. 2, the spacing between the upstream end portions of first rib 3, of second rib 5 (which is connected to first rib 3 at this end portion), and of third rib 7, on the one hand, and front sealing tip 11, on the other hand, may indicate a connection of ribs 3, 5, 7 in the region of shroud segment surface 15. In contrast, the downstream end portions of ribs 3, 5, 7 are, in this view, directly connected to rear sealing tip 13, which indicates a connection in the radially outermost region of sealing tip 13. This is also directly visible in FIG. 1.

Further, in this exemplary embodiment, the end portion of the downstream connection between second rib 5 and third rib 7 is disposed directly at the joint surface 27 of shroud segment 100 facing the next adjacent shroud segment (not shown in FIG. 2), as viewed in circumferential direction u. Joint surface 27 may be referred to as a contact surface.

In this exemplary embodiment, joint surface 27 is a substantially Z-shaped joint surface 27. A shroud having such Z-shaped joint surfaces 27 may be referred to as a Z-shroud.

The polygonal pockets 17, 19 already described with reference to FIG. 1 have a plurality of bordering surfaces. The surfaces are, in particular, side faces. Depending on the specific design, pockets 17, 19 may have four, five, six, or more side faces. The side faces may be disposed, for example, at the junction between first rib 3 and second rib 5, at the junction between second rib 5 and third rib 7, as well as at the junctions between ribs 3, 5, 7 and sealing tips 11, 13. More than three side faces may advantageously increase the stiffness of the inventive shroud segment 100.

The three angles W1, W2, W3 between the direction of the axis of rotation of the blade; i.e., axial direction a, and the longitudinal orientations or main axes 21, 23, 25 of ribs 3, 5, 7, as viewed in flow direction 9, are between zero and eighty degrees. In this exemplary embodiment, angle W1 between axial direction a and main axis 21 is about third degrees (30°), angle W2 between axial direction a and main axis 23 is about sixty degrees (60°) and angle W3 between axial direction a and main axis 25 is about thirty degrees (30°).

The end portion of first rib 3 located at rear sealing tip 13 is disposed in the middle third L1 relative to the length L of shroud segment 100 in circumferential direction u.

LIST OF REFERENCE CHARACTERS

100 shroud segment
W1, W2, W3 angles between axial axis a and the main axes of the ribs
L length of the shroud segment in the circumferential direction
1 airfoil
a axial direction, axis of rotation of the blade
u circumferential direction
r radial direction
3 first rib
5 second rib
7 third rib
9 main flow direction through the turbomachine
11 front sealing tip; upstream sealing tip
13 rear sealing tip; downstream sealing tip
15 shroud segment surface
17 first polygonal pocket
19 second polygonal pocket
21 first main axis
23 second main axis
25 third main axis
27 joint surface; contact surface

What is claimed is:

1. A shroud segment for disposition on a blade of a turbomachine, the shroud segment comprising:

a stiffening structure raised above a shroud segment surface, the stiffening structure including at least three interconnected ribs, a first end portion of the ribs being connected to an upstream sealing tip of the shroud segment, and a second end portion of the ribs being connected to a downstream sealing tip of the shroud segment, wherein angles between a direction of the axis of rotation of the blade and longitudinal orientations of the ribs, as viewed in the direction of flow through the turbomachine, are between zero degrees and eighty degrees;

wherein a mean camber line of an airfoil of the blade intersects a first, second and third rib of the ribs at an angle or angles of between 30° and 90° when viewed radially.

2. The shroud segment as recited in claim 1 wherein the three interconnected ribs form a Z-shaped rib structure.

3. The shroud segment system as recited in claim 1 wherein a first rib first end portion of the first rib of the ribs is connected to a second rib first end portion of the second rib of the ribs, and the connected first rib first end portion and second rib first end portion are disposed at the upstream sealing tip, and a third rib first end portion of the third rib of the ribs is disposed at the upstream sealing tip at an offset in a circumferential direction from the connected first rib first end portion and second rib first send portion.

4. The shroud segment as recited in claim 1 wherein the angle between the direction of the axis of rotation of the blade and the longitudinal orientation of the first rib of the ribs is between 0° and 45°, the angle between the direction of the axis of rotation of the blade and the longitudinal orientation of the third rib of the ribs is between 0° and 45° or the angle between the direction of the axis of rotation of the blade and the longitudinal orientation of the second rib of the ribs is between 30° and 80°.

5. The shroud segment as recited in claim 1 wherein the mean camber line intersects the second rib at an angle or angles of between 45° and 90° when viewed radially.

6. The shroud segment as recited in claim 1 wherein a first rib second end portion of the first rib of the ribs is disposed at the downstream sealing tip, and a second rib second end portion of the second rib of the ribs is connected to a third rib second end portion of the third rib of the ribs, and the connected second rib second end portion and third rib second end portion are disposed at the downstream sealing tip at an offset in the circumferential direction from the first rib second end portion of the first rib.

7. The shroud segment as recited in claim 1 wherein a first polygonal pocket is formed between the first rib of the ribs, the second rib of the ribs and the downstream sealing tip, and wherein a second polygonal pocket is formed between the second rib, the third rib of the ribs and the upstream sealing tip.

8. The shroud segment as recited in claim 1 wherein the three ribs are straight along their longitudinal orientations.

9. The shroud segment as recited in claim 1 wherein a third rib end portion of the third rib of the ribs is located at the downstream sealing tip and is disposed at a joint surface of the shroud segment facing a next adjacent shroud segment.

10. The shroud segment as recited in claim 1 wherein a first rib end portion of the first rib of the ribs is located at the downstream sealing tip and is disposed in a middle third relative to a length of the shroud segment in a circumferential direction.

11. The shroud segment as recited in claim 1 wherein angles W1, W3 between the direction of the axis of rotation of the blade and longitudinal orientations of the first rib and the third rib of the ribs as viewed in the direction of flow through the turbomachine, are zero degrees or between twenty degrees and seventy degrees.

12. The shroud segment as recited in claim 11 wherein the angles W1, W3 are between thirty degrees and seventy degrees.

13. The shroud segment as recited in claim 1 wherein the ribs have a constant height in a radial direction over a circumference.

14. The shroud segment as recited in claim 1 wherein the shroud segment is manufactured as a single piece by a casting process, by a material-removal process, in particular by milling, or by a generative manufacturing process.

15. The shroud segment as recited in claim 14 wherein the shroud segment is manufactured by a material-removal process.

16. A blade of a turbomachine, the blade comprising a shroud segment as recited in claim 1.

17. A gas turbine comprising the blade as recited in claim 16.

18. A shroud segment for disposition on a blade of a turbomachine, the shroud segment comprising:

a stiffening structure raised above a shroud segment surface, the stiffening structure including at least three interconnected ribs, a first end portion of the ribs being connected to an upstream sealing tip of the shroud segment, and a second end portion of the ribs being connected to a downstream sealing tip of the shroud segment, wherein angles between a direction of the axis of rotation of the blade and longitudinal orientations of the ribs, as viewed in the direction of flow through the turbomachine, are between zero degrees and eighty degrees;

wherein a first rib end portion of a first rib of the ribs is located at the downstream sealing tip and is disposed in a middle third relative to a length of the shroud segment in a circumferential direction.

19. The shroud segment as recited in claim 18 wherein the three ribs are straight along their longitudinal orientations.

* * * * *